US008770077B2

(12) United States Patent
Hirata

(10) Patent No.: US 8,770,077 B2
(45) Date of Patent: Jul. 8, 2014

(54) PUNCH PRESS DEVICE

(75) Inventor: Kazuyuki Hirata, Toyota (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 401 days.

(21) Appl. No.: 13/084,824

(22) Filed: Apr. 12, 2011

(65) Prior Publication Data

US 2011/0252938 A1 Oct. 20, 2011

(30) Foreign Application Priority Data

Apr. 15, 2010 (JP) ..... 2010-093969

(51) Int. Cl.
*B26D 5/00* (2006.01)
*B21D 28/22* (2006.01)
*B21D 28/00* (2006.01)

(52) U.S. Cl.
CPC ..... *B21D 28/22* (2013.01); *B21D 28/007* (2013.01)
USPC ..... 83/613; 83/618; 83/619

(58) Field of Classification Search
CPC ..... H01F 7/06; H01F 7/08; H01F 7/081; H01F 7/16; B21D 28/00; B21D 28/20; B26D 5/00; B26D 5/08; B26D 5/086; B26F 1/38; B26F 1/40; B30B 1/00; B30B 1/42
USPC ..... 83/613, 616, 618, 619, 623, 624, 548, 83/550, 684, 687, 691
See application file for complete search history.

(56) References Cited

U.S. PATENT DOCUMENTS

| | | | | |
|---|---|---|---|---|
| 4,782,998 | A | 11/1988 | Nishikawa et al. | |
| 5,075,150 | A | 12/1991 | Webb et al. | |
| 5,636,432 | A | 6/1997 | Usher et al. | |
| 5,992,536 | A | 11/1999 | Shimada et al. | |
| 6,053,258 | A | 4/2000 | Shimada et al. | |
| 6,109,161 | A | 8/2000 | Shimada et al. | |
| 2004/0100345 | A1 * | 5/2004 | Kobayashi | 335/220 |
| 2011/0024489 | A1 | 2/2011 | Sakakibara et al. | |

FOREIGN PATENT DOCUMENTS

| | | |
|---|---|---|
| CN | 101327507 | 12/2008 |
| JP | 2-36332 | 10/1986 |
| JP | 61-289923 | 12/1986 |
| JP | 63-123538 | 5/1988 |

(Continued)

OTHER PUBLICATIONS

U.S. Appl. No. 13/090,341 to Kazuyuki Hirata, filed Apr. 20, 2011.

(Continued)

*Primary Examiner* — Phong Nguyen
(74) *Attorney, Agent, or Firm* — Greenblum & Bernstein, P.L.C.

(57) ABSTRACT

A punch press device has a lift that can move up and down with respect to a workpiece and a punch that is supported by the lift and can move up and down with respect to the lift. Further, the punch press device has a switching member that reciprocates between a position where the punch is constrained so that it moves down together with the lift and a position where the punch is released so that it moves up with respect to the lift. The punch press device has two electromagnetic solenoids for reciprocating the switching member. The first electromagnetic solenoid moves the switching member in a first direction, and the second electromagnetic solenoid moves the switching member in a second direction opposite to the first direction.

4 Claims, 8 Drawing Sheets

(56) References Cited

FOREIGN PATENT DOCUMENTS

| | | |
|---|---|---|
| JP | 6-063662 | 3/1994 |
| JP | 7-169896 | 7/1995 |
| JP | 8-323695 | 12/1996 |
| JP | 9-323199 | 12/1997 |
| JP | 10-249447 | 9/1998 |
| JP | 10-249450 | 9/1998 |
| JP | 11-69733 | 3/1999 |

OTHER PUBLICATIONS

China Office action, dated Mar. 13, 2013 along with an english translation thereof.
Japanese Office action, mail date is Nov. 19, 2013.

* cited by examiner

PUNCH PRESS DEVICE

BACKGROUND OF THE INVENTION

The present invention relates to a punch press device for stamping out core plates for motor cores from a hoop material, which is used in manufacturing motor cores such as stator cores or rotor cores.

Specifically, Japanese Examined Patent Publication No. 2-36332 discloses a method for manufacturing motor cores M such as rotor cores. According to the disclosure of this document, as shown in FIGS. 5 and 6, a punch press device stamps out core plates P consecutively from a metal hoop material and laminates a plurality of stamped out core plates P. Protrusions Pa are formed on each core plate F. The protrusions Pa of a core plate P are engaged with recesses on the back face of the adjacent core plate P. Thus, the plurality of core plates P are joined to each other in a laminated state. Also, for example, on every 100th core plates P to be laminated, holes Pb are formed instead of protrusions Pa. When the protrusions Pa of a core plate P are engaged with the holes Pb of the adjacent core plate P, the core plate P having the holes Pb does not engage with the adjacent core plate P. Thus, the laminated core plates P are separated at every nth piece. The motor core M is composed of groups of a predetermined number of laminated core plates P.

As described above, in the case where a plurality of core plates P are stamped out by a punch press device, holes Pb are punched out, instead of formation of protrusions Pa, on every nth core plate, where n is a predetermined number. In this case, as shown in FIG. 7, holes Pb are preformed at the points on the hoop material W from which core plates P will be punched out. No hole Pb is formed at the points on the hoop material W where core plates P having protrusions Pa will be stamped out. After that, when protrusions Pa are formed at the points on the hoop material W from which core plates P will be stamped out, the portions having the holes Pb on the hoop material W are blank-stamped by the punch press device. Therefore, no protrusion Pa is formed on the portions where the holes Pb have been formed on the hoop material W.

As a punch press device as described above, proposed are, for example, the punch press devices having the configurations as shown in FIGS. 8 to 11.

As shown in FIG. 8, when the switching member 45 is moved to the right end in FIG. 8 by the shift plate 46, the upper end face of the punch 44 is brought into contact with the lower face of the switching member 45. As a result, the punch 44 is constrained so that it cannot be moved upward relative to the lift 43. Therefore, when the lift 43 moves down toward the hoop material W, the punch 44 moves down together with the lift 43. Thus, holes Pb are formed on the hoop material W by the punch 44.

On the contrary, when the switching member 45 is moved to the left end in FIG. 8 by the shift plate 46, the upper end 44*a* of the punch 44 is disposed in the recess 45*a* of the switching member 45. As a result, the punch 44 is released from the constrained state as described above and is allowed to move up relative to the lift 43. Therefore, when the lift 43 moves down toward the hoop material W, the punch 44 is brought into contact with the hoop material W as shown by the chain lines in FIG. 8, thereby moving up relative to the lift 43. As a result, no hole Pb is formed on the hoop material W by the punch 44.

According to the configuration shown in FIG. 8, the switching member 45 reciprocates between the constraining position and the releasing position. To that end, an air cylinder 47 is supported by the side of the lift 43. The air cylinder 47 is connected to the shift plate 46 via the piston rod 47*a*. The piston rod 47*a* of the air cylinder 47 projects and retracts, thereby changing over the position of the switching member 45 between the constraining position and the releasing position. Thus, holes Pb are punched through the hoop material W.

According to the configuration shown in FIG. 9, a servo motor 48 is supported by the side of the lift 43. A cam 49 is installed to the motor shaft 48*a* of the servo motor 48. A contact roller 50 that can come in contact with the cam 49 is supported on one end of the shift plate 46. On the other end of the shift plate 46, a spring 51 is attached, which biases the contact roller 50 toward a direction where it is brought into contact with the cam 49. The cam 49 is rotated by the servo motor 48, thereby changing over the position of the switching member 45 between two positions, the constraining position and the releasing position.

According to the configuration shown in FIG. 10, a servo motor 48 is supported by the punch press device body 52. A cam 49 is provided for the motor shaft 48*a* of the servo motor 48. An interlocking member 53, while being inserted into through hole of the body 52, is supported so that it can move in the same direction as that of the switching member 45. A contact roller 50 that can come in contact with the cam 49 is supported on one end of the interlocking member 53. On the other end of the interlocking member 53, a sliding contact plate 54 is installed. A contact portion 55, which can slidably contact with the sliding contact plate 54, is installed on one end of the shift plate 46. A spring 51 is installed on the other end of the shift plate 46. The cam 49 is rotated by the servo motor 48, thereby allowing the switching member 45 to move via the interlocking member 53. Thus, the position of the switching member 45 is changed over between two positions, the constraining position and the releasing position.

According to the configuration shown in FIG. 11, an electromagnetic solenoid 56 is supported by the side of the lift 43. The movable iron core 56*a* of the electromagnetic solenoid 56 is connected to one end of the shift plate 46 via the connecting plate 57. On the other end of the shift plate 46, a spring 58 is installed, which biases the switching member 45 toward the left direction in FIG. 11. When the electromagnetic solenoid 56 is demagnetized, the switching member 45 is switched to the releasing position by the biasing force of the spring 58. Therefore, no hole Pb is formed on the hoop material W. When the electromagnetic solenoid 56 is excited, the position of the switching member 45 is changed over to the constraining position against the biasing force of the spring 58. As a result, holes Pb are formed on the hoop material W.

The above conventional configurations, however, have the problems described below.

In the conventional configuration shown in FIG. 8, an air cylinder 47 is used as a driving source for changing over the position of the switching member 45 between the constraining position and the releasing position. In this case, there is a problem in that the responsiveness of the air cylinder 47 is not good, resulting in reduction of the tracking performance in punching of holes Pb at high speed.

In the conventional configuration shown in FIG. 9, a servo motor 48 is used as a driving source for changing over the position of the switching member 45. There is a problem that the servo motor 48 moves up together with the lift 43 and vibrations caused by the elevation of the lift 43 are transmitted to the servo motor 48, resulting in frequent occurrence of failure in the servo motor 48.

In the conventional configuration shown in FIG. 10, a servo motor 48 for changing over the position of the switching member 45 is supported by the punch press device body 52. This prevents vibrations caused by the elevation of the lift 43 from being transmitted to the servo motor 48. It is necessary, however, to place an interlocking mechanism such as the interlocking member 53 between the cam 49 rotated by the servo motor 48 and the shift plate 46 supporting the switching member 45. This results in a problem in that the structure of the device becomes complex.

In the conventional configuration shown in FIG. 11, the position of the switching member 45 is changed over to the releasing position by the biasing force of the spring 58, and the position of the switching member 45 is changed over to the constraining position by excitation of the electromagnetic solenoid 56. Therefore, there is a problem in that the position of the switching member 45 cannot be changed over when the spring force of the spring 58 is reduced due to continued use of the device.

SUMMARY OF THE INVENTION

An objective of the present invention is to provide a punch press device that has a simplified structure and can change over the position of the switching member between the constraining position and the releasing position at high speed and with precision.

To achieve the foregoing objective and in accordance with one aspect of the present invention, a punch press device is provided that includes a lift, a punch, a switching member, a first electromagnetic driving means, and a second electromagnetic driving means. The lift is movable up and down with respect to a workpiece. The punch is supported by the lift and movable up and down with respect to the lift. The switching member reciprocates between a position where the punch is constrained so as to move down together with the lift and a position where the punch is released so as to move up with respect to the lift. The first electromagnetic driving means moves the switching member in a first direction. The second electromagnetic driving means that is different from the first electromagnetic driving means moves the switching member in a second direction opposite to the first direction.

DETAILED DESCRIPTION OF THE PREFERRED EMBODIMENTS

Hereinafter, a punch press device according to one embodiment of the present invention will be described with reference to FIGS. 1 to 4.

Figure 1A:
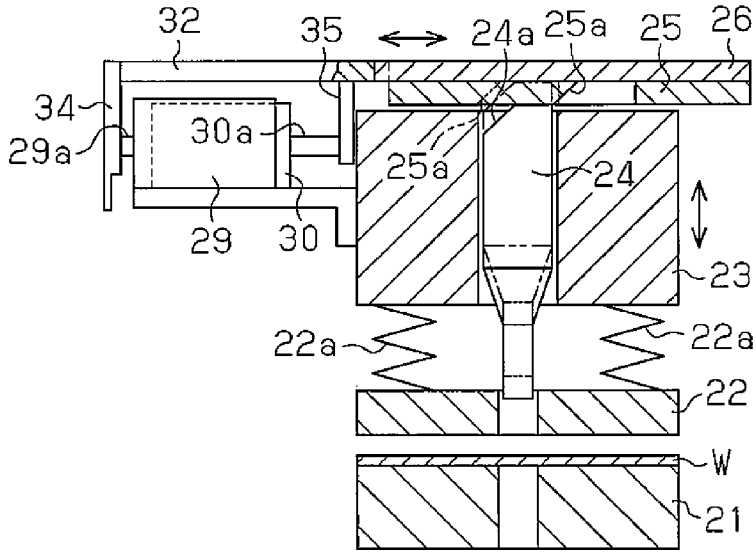
FIGS. 1A to 1C are cross-sectional views showing an operation of the punch press device according to one embodiment of the present invention.
Figure 1B:
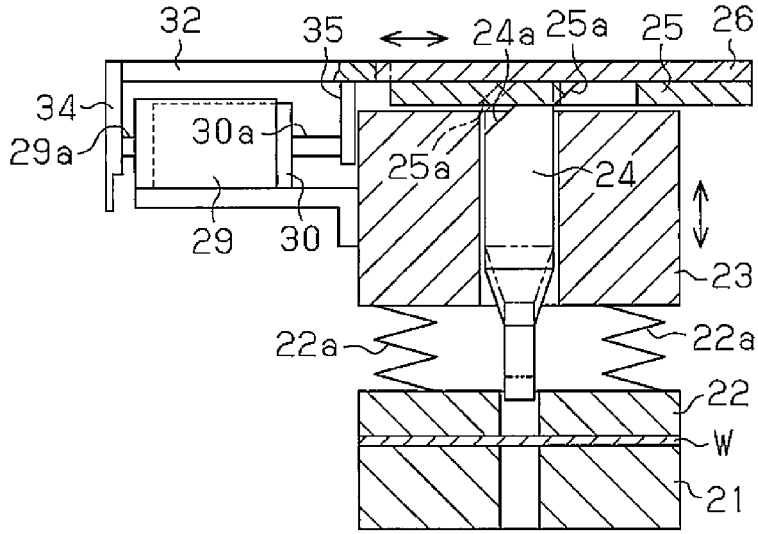
Figure 1C:
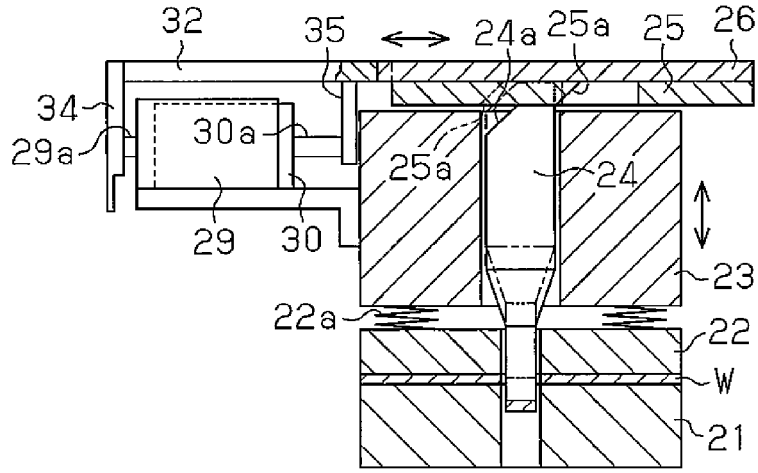
Figure 7:
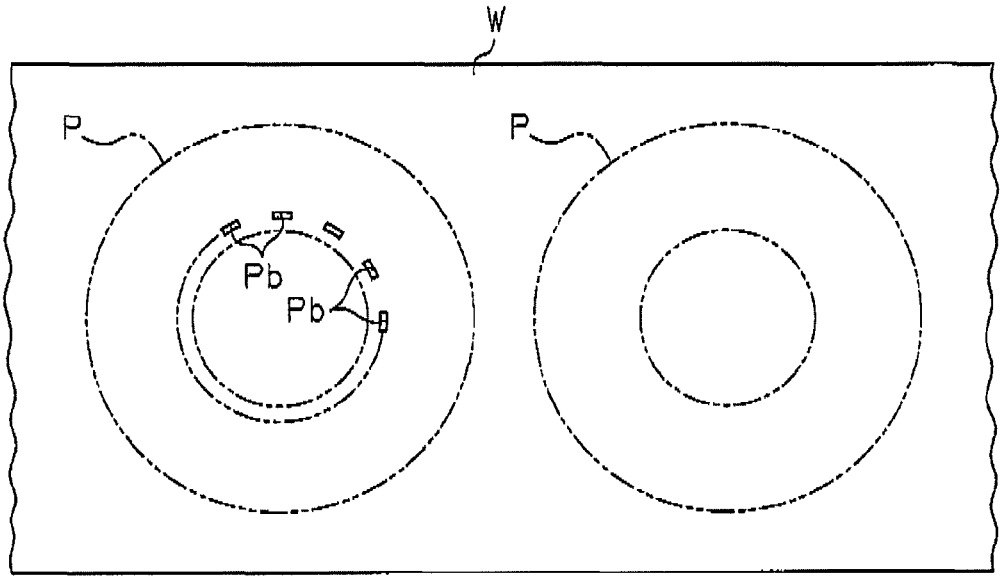
Fig.7(Prior Art)
FIG. 7 is an explanatory top view of a hoop showing stamping out of core plates P by a conventional punch press device.
Figure 8:
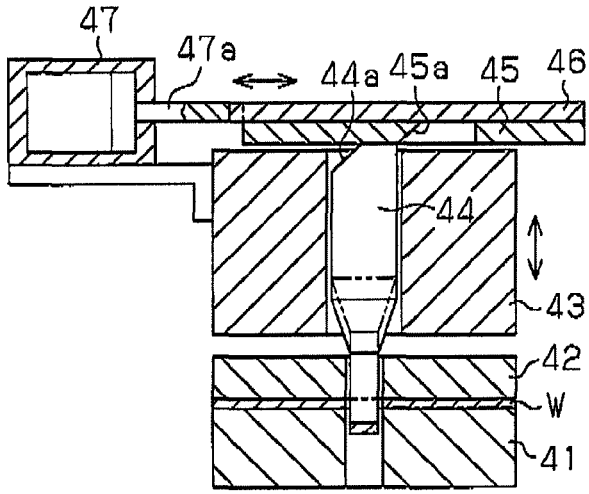
Fig.8(Prior Art)
FIG. 8 is a cross-sectional view of a conventional punch press device.
Figure 9:
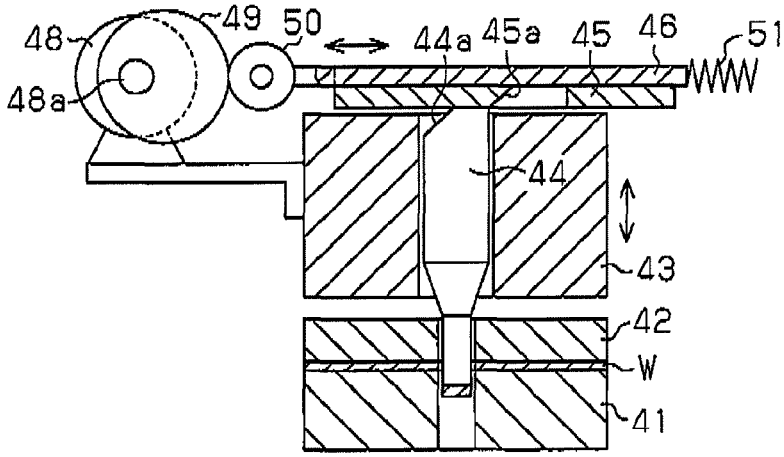
Fig.9(Prior Art)
FIG. 9 is a cross-sectional view of another conventional punch press device.
Figure 10:
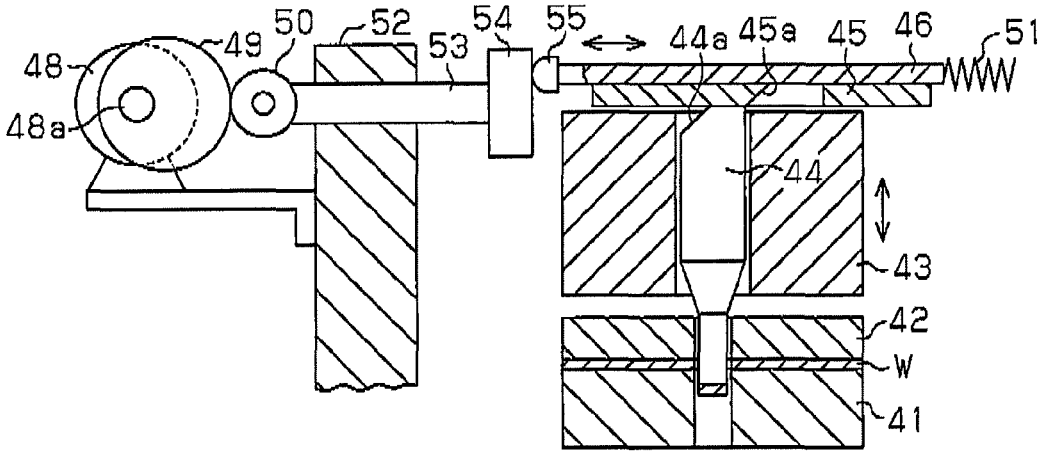
Fig.10(Prior Art)
FIG. 10 is a cross-sectional view of another conventional punch press device.
Figure 11:
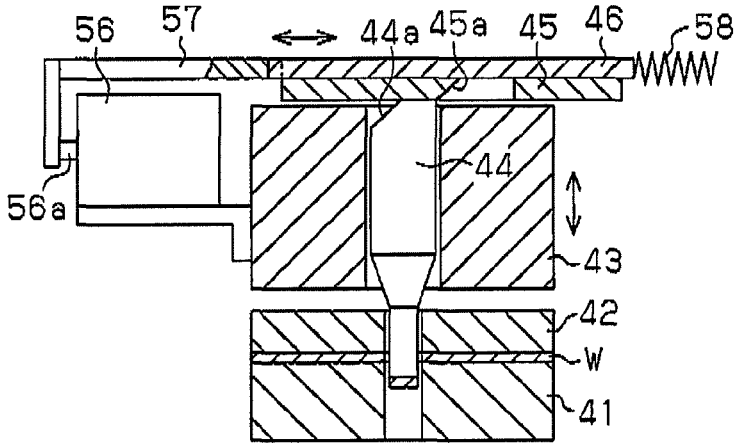
Fig.11(Prior Art)
FIG. 11 is a cross-sectional view of the other conventional punch press device.

As shown in FIGS. 1A to 1C, a hoop material W for use as a workpiece shown in FIG. 7 is placed on a die 21 of the punch press device. The hoop material W is pressed by a holding member 22 and held on the die 21. Over the hoop material W, the lift 23 is disposed so that it can move up and down. The punch 24, as inserted into the through hole of the lift 23, is supported so as to be movable upward and downward relative to the lift 23. The punch 24 forms holes Pb at points on the hoop material W where core plates P will be stamped out. In the drawings, there is a gap between the inner peripheral face of the through hole of die 21 and the outer peripheral face of the punch 24. Actually, however, there is little gap between them. The holding member 22 is supported by the lower face of the lift 23 via the spring 22*a*. On the lift 23, the switching member 25, being attached to the shift plate 26, is disposed. The switching member 25 can move in the lateral direction orthogonal to the moving direction of the punch 24. In the center of the switching member 25, a recessed portion 25*a* is formed.

The shift plate 26 changes the position of the switching member 25 to the constraining position at the right end shown in FIGS. 1A to 1C. In this state, the upper end 24*a* of the punch 24 is brought into contact with the lower face of the switching member 25. As a result, the punch 24 is constrained so that it cannot be moved upward relative to the lift 23. Therefore, when the lift 23 moves down toward the hoop material W, the punch 24 moves down together with the lift 23. As a result, holes Pb are formed on the hoop material W by the punch 24.

On one hand, the shift plate 26 changes over the position of the switching member 25 to the releasing position at the left end shown by the lines formed by a long dash alternating with two short dashes in FIGS. 1A to 1C. In this state, the upper end 24*a* of the punch 24 is placed in the recessed portion 25*a* of the switching member 25. As a result, the punch 24 is released from the previously mentioned constraining state and is allowed to move up with respect to the lift 23. Therefore, when the lift 23 moves down toward the hoop material W, the punch 24 is brought into contact with the hoop material W as shown by the lines formed by a long dash alternating with two short dashes lines in FIG. 1, thereby moving up with respect to the lift 23. Consequently, no hole Pb is formed on the hoop material W by the punch 24.

Next, the drive mechanism for changing over the position of the switching member 25 between the constraining position and the releasing position will be described.

As shown in FIGS. 2 to 4 and 12, a housing 27 is installed to the side of the lift 23 via the bracket 28. In the housing 27, a first direct-acting electromagnetic solenoid 29 and a second direct-acting electromagnetic solenoid 30 as an electromagnetic driving means are accommodated. One of the first and second electromagnetic solenoids 29 and 30 moves the switching member 25 in a first direction and the other moves the switching member 25 in a second direction opposite to the first direction. Specifically, the first electromagnetic solenoid 29 moves the switching member 25 to the constraining position at the right end shown in FIGS. 1A to 1C. The first electromagnetic solenoid 29 has a movable iron core 29*a* as an armature. The movable iron core 29*a* projects from the first electromagnetic solenoid 29 to the side opposite to the switching member 25.

On the other hand, the second electromagnetic solenoid 30 moves the switching member 25 to the releasing position at the left end shown by the lines formed by a long dash alternating with two short dashes in FIGS. 1A to 1C. The second electromagnetic solenoid 30 has a movable iron core 30*a* as an armature. The movable iron core 30*a* projects from the second electromagnetic solenoid 30 toward the switching member 25. The movable iron core 30*a* of the second electromagnetic solenoid 30 is in parallel with the movable iron core 29*a* of the first electromagnetic solenoid 29. When one of the first and second electromagnetic solenoids 29 and 30 is excited, the other electromagnetic solenoid is demagnetized. Neither of the first electromagnetic solenoid 29 nor the second electromagnetic solenoid 30 has an inner spring. Therefore, when the power supply to the first and the second electromagnetic solenoids 29 and 30 is shut off, both of the movable iron cores 29*a* and 30*a* are in a free state.

On the upper face of the housing 27, a pair of guide rails 31 is laid. The pair of guide rails 31 is in parallel with each other, and each extends along the moving direction of the switching member 25. On the guide rails 31, the moving body 32 is movably supported via the guide member 33. At the left end in FIG. 2 of the moving body 32, the first connecting plate 34 extending downward is fixed. The lower end of the first connecting plate 34 is connected to the iron core 29*a* of the first electromagnetic solenoid 29. At the right end in FIG. 2 of the moving body 32, the second connecting plate 35 extending downward is fixed. The lower end of the second connecting plate 35 is connected to the iron core 30*a* of the second electromagnetic solenoid 30.

Figure 2:
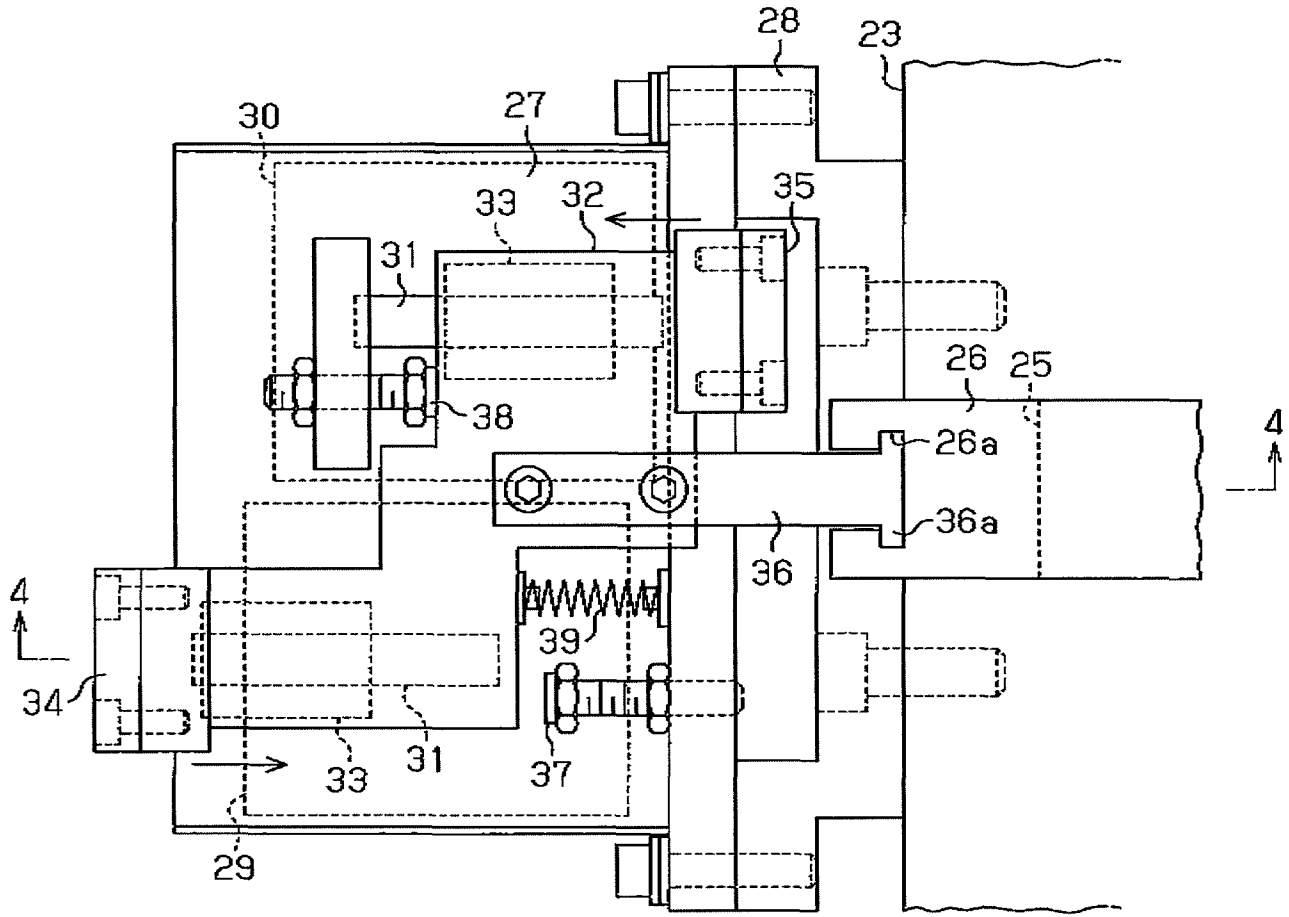
FIG. 2 is an enlarged partial plan view showing the drive mechanism of the switching member in the punch press device.
Figure 3:
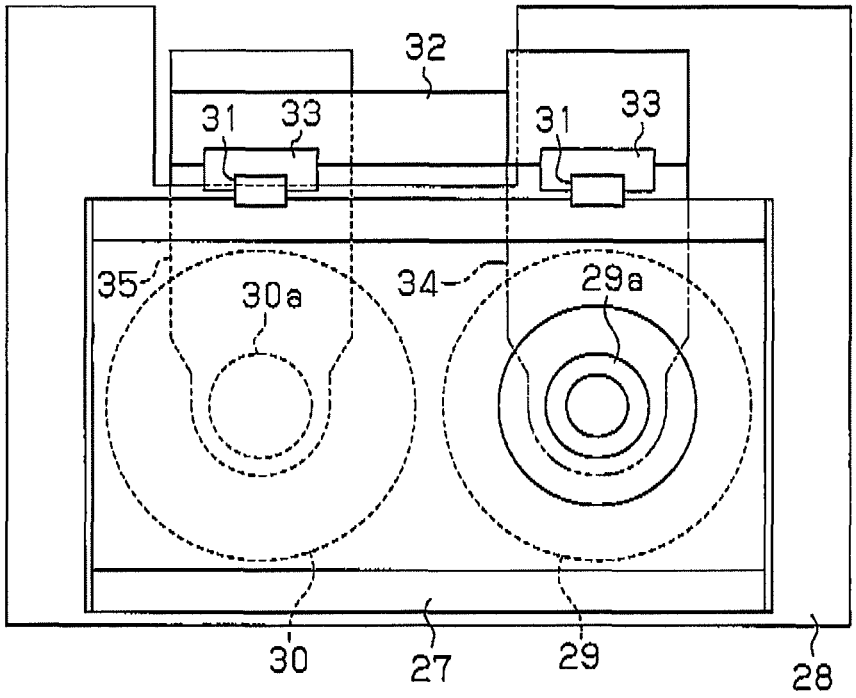
FIG. 3 is a side view of the drive mechanism.
Figure 4:
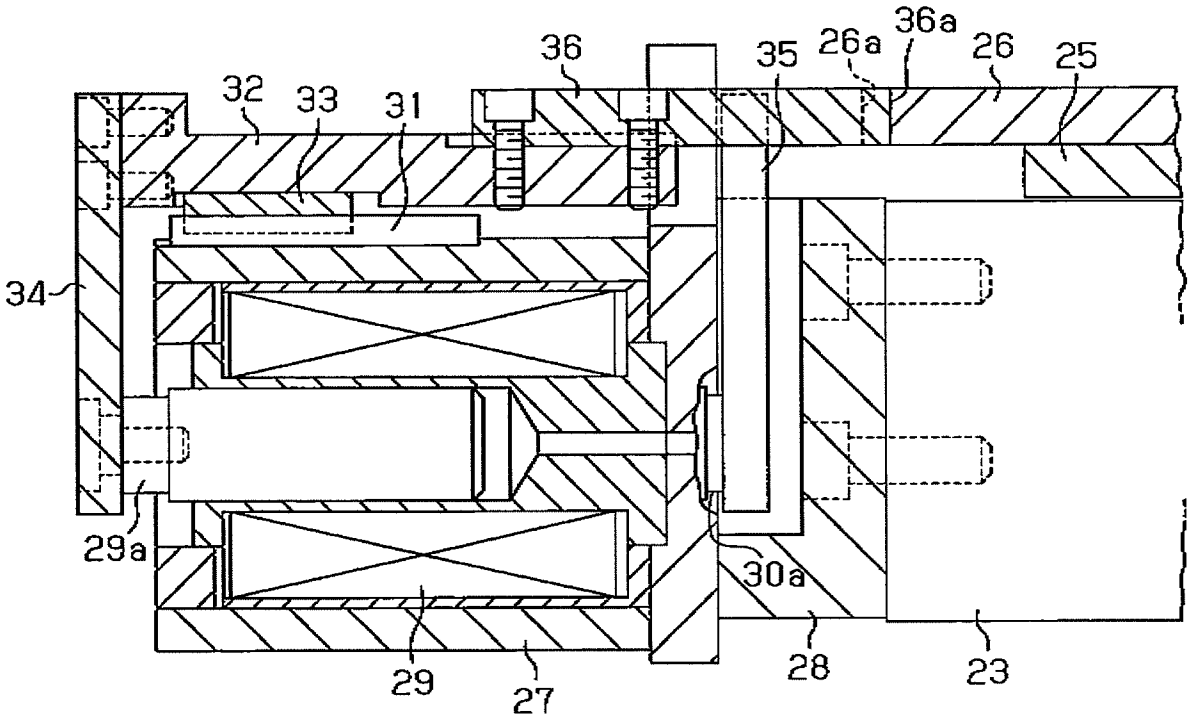
FIG. 4 is a cross-sectional view taken along line 4-4 of FIG. 2.
Figure 5:
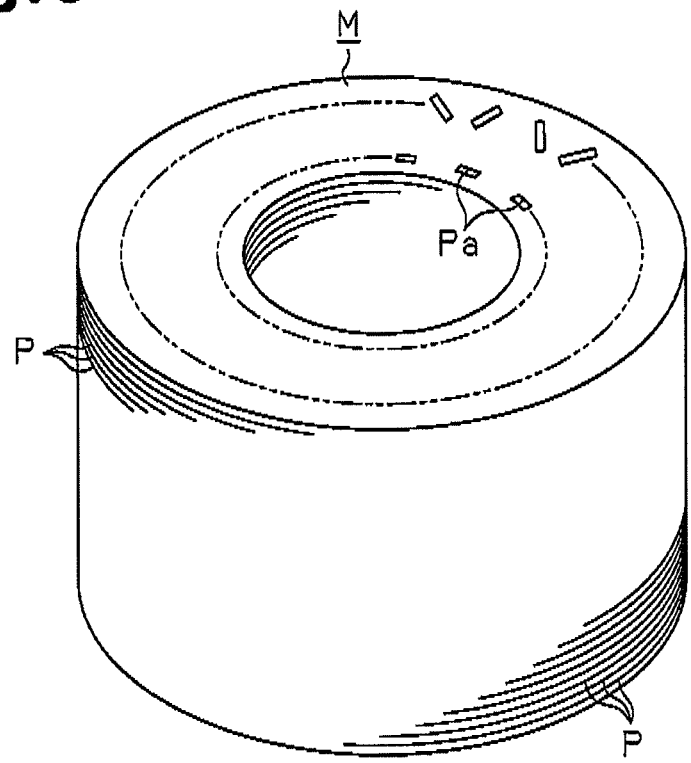
FIG. 5 is a perspective view showing the rotor core of a motor.
Figure 6:
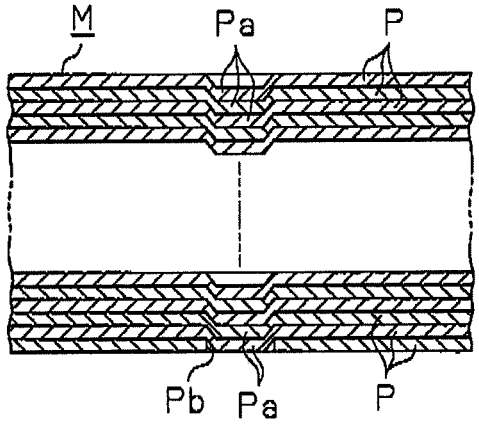
FIG. 6 is an enlarged partial cross-sectional view of the vicinity of protrusions of the rotor core.
Figure 12:
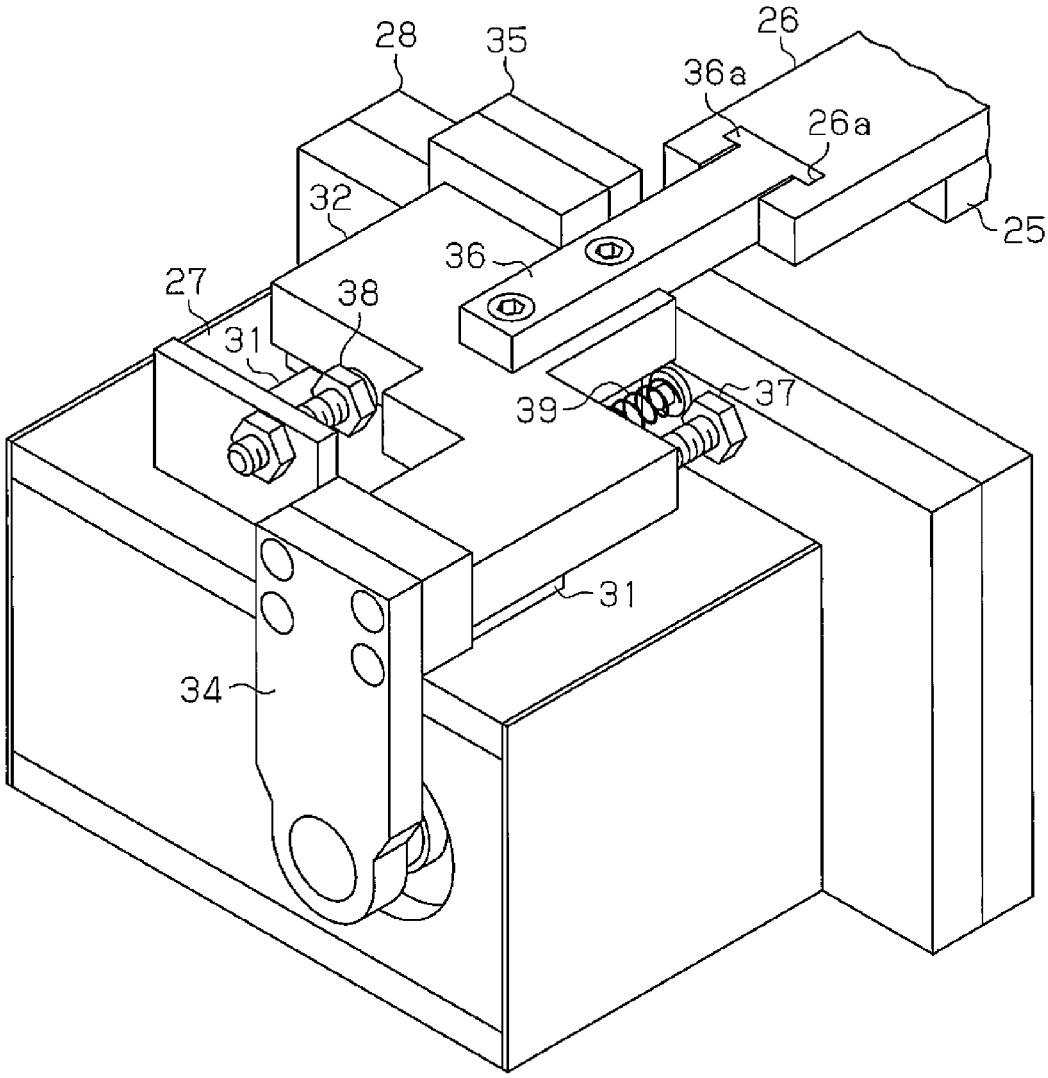
FIG. 12 is a perspective view of the drive mechanism of FIGS. 2 and 3.

As shown in FIGS. 2, 4 and 12, the connecting bar 36 is fixed on the upper face of the moving body 32. At the end of the connecting bar 36, a pair of protruding connecting portions 36*a* projecting in opposite directions to each other is formed. At the end of the shift plate 26 on the switching member 25, the recessed connecting portion 26*a* is formed. The pair of protruding connecting portions 36*a* is connected to the recessed connecting portion 26*a* of the shift plate 26. On the upper face of the housing 27, a pair of stop bolts 37 and 38 is fixed. The stop bolts 37 and 38 define the movement end in the first direction and the movement end in the second direction of the moving body 32, respectively. The definition of the movement ends of the moving body 32 by the stop bolts 37 and 38 allows the switching member 25 to be located in either the constraining position or the releasing position.

As shown in FIGS. 2 and 12, an auxiliary spring 39 as a biasing means is installed between the end of the housing 27 and the moving body 32. The spring 39 biases the moving body 32 in one of the first and the second directions (in the second direction in the embodiment) by the biasing force smaller than the driving force of the electromagnetic solenoids 29 and 30. Therefore, when the power supply to both of the electromagnetic solenoids 29 and 30 is shut off, the switching member 25 is held at the releasing position (at the releasing position in the embodiment).

Next, the operation of the above punch press device will be explained.

When the power supply to the electromagnetic solenoids 29 and 30 is shut off, the biasing force of the auxiliary spring 39 moves the moving body 32 to the movement end on the left side shown in FIG. 2 (in the second direction) and holds the switching member 25 in the releasing position on the left side shown in FIG. 2. In this state, after the power of the punch press device is turned on, the first electromagnetic solenoid 29 and the second electromagnetic solenoid 30 are selectively excited. This allows the position of the switching member 25 to be changed over between the constraining position and the releasing position, so that holes Pb are punched in the hoop material W or not punched out.

That is, when the first electromagnetic solenoid 29 is excited, the moving body 32 moves to the right in FIGS. 2 and 4 (in the first direction) along the guide rails 31 and the position of the switching member 25 is changed over to the constraining position at the right side shown in FIGS. 2 and 4. In this state, as shown in FIG. 1, the upper end of the punch 24 is brought into contact with the lower face of the switching member 25. As a result, the punch 24 is constrained with respect to the lift 23 so that it cannot move up. Therefore, when the lift 23 moves down toward the hoop material W, the punch 24 moves down together with the lift 23. As a result, holes Pb shown in FIG. 7 are formed on the hoop material W by the punch 24.

On the other hand, when the second electromagnetic solenoid 30 is excited, the moving body 32 moves to the left in FIGS. 2 and 4 (in the second direction) along the guide rails 31, and the position of the switching member 25 is changed over to the releasing position at the left shown in FIGS. 2 and 4. In this state, the upper end 24*a* of the punch 24 is placed in the recessed portion 25*a* of the switching member 25. As a result, the punch 24 is released from the constraining state mentioned above and is allowed to move up with respect to the lift 23. Therefore, when the lift 23 moves down toward the hoop material W, the punch 24 is brought into contact with the hoop material W as shown by the lines formed by a long dash alternating with two short dashes in FIG. 1, thereby moving up with respect to the lift 23. As a result, no hole Pb is formed on the hoop material W by the punch 24.

According to this embodiment, the advantages described below are obtained.

(1) The movement of the switching member 25 in the first direction is performed by the first electromagnetic solenoid 29, and the movement of the switching member 25 in the second direction is performed by the second electromagnetic solenoid 30. That is, the first and the second electromagnetic solenoids 29 and 30 are selectively used, thereby allowing the position of the switching member 25 to be changed over between the constraining position and the releasing position of the punch 24. Therefore, unlike the conventional configuration using an air cylinder as a driving source of the switching member, the tracking performance in switching the punching operation can be maintained at a high level.

In addition, unlike the conventional configuration using a servo motor as a driving source of the switching member, even if the electromagnetic solenoids 29 and 30 are supported by the lift 23, a failure in the electromagnetic solenoids 29 and 30 is hardly caused by vibrations due to the upward and downward movement of the lift 43. Therefore, it is not necessary to provide a complex interlocking mechanism between the electromagnetic solenoids 29 and 30 and the switching member 25. As a result, the structure of the whole device is simplified. Furthermore, unlike the conventional configuration in which the position of the switching member is changed over between two positions by a spring and an electromagnetic solenoid, a weakening of the spring force does not disable the change-over of the position of the switching member. Therefore, the position of the switching member 25 can be changed over precisely between two positions, constraining position and releasing position.

(2) The auxiliary spring 39 biases the switching member 25 in one of the first and the second directions with a force smaller than that of each of electromagnetic solenoids 29 and 30. Therefore, when the power of the punch press device is turned off and both of the electromagnetic solenoids 29 and 30 are demagnetized, the switching member 25 is biased in one of the first and second directions by the biasing force of the auxiliary spring 39 and held there. As a result, the electrical load applied when the power of the punch press device is turned on can be reduced. Therefore, a small-sized electromagnetic solenoid having a small drive force can be used. In this embodiment, the spring 39 is provided in order to move the iron cores 29*a* and 30*a* of the demagnetized electromagnetic solenoids 29 and 30 in one of the first and the second directions and prevents rattling. Therefore, not so heavy a load is applied, preventing the spring force from being reduced. Even if the spring force is reduced, the operation of the switching member 25 is not affected.

(3) In this punch press device, the use of the auxiliary spring 39 eliminates the need for continuously energizing the electromagnetic solenoids 29 and 30. As a result, the time for energizing the electromagnetic solenoids 29 and 30 can be shortened, resulting in reduction of power consumption and prevention of heat generation. In addition, a large-capacity solenoid which is superior in responsiveness and reliability of operation can be used.

(4) The moving body 32 is movably supported on the pair of guide rails 31 via the guide member 33. The moving body 32 is moved on the guide rails 31 by the electromagnetic solenoids 29 and 30, thereby allowing the switching member 25 to reciprocate. Therefore, excitation and demagnetization of the first and the second electromagnetic solenoids 29 and 30 allow the position of the switching member 25 to be changed over between two positions, the constraining position and the releasing position, smoothly and precisely. Consequently, the tracking performance in switching the punching operation can be kept at a high level, and the switching accuracy in switching the punching operation is improved.

(5) In the punch press device, the direct-acting electromagnetic solenoids 29 and 30, in which the armature moves linearly, are used. This reduces failures in the punch press device and a smooth operation can be obtained. In addition, the iron cores 29*a* and 30*a* of the electromagnetic solenoids 29 and 30 are connected by one moving body 32 as a connecting member. Furthermore, the moving body 32 is connected to the switching member 25. Therefore, the number of parts is reduced and the switching member 25 can be moved precisely by actuation of the electromagnetic solenoids 29 and 30.

This embodiment may be modified as described below.

As an electromagnetic driving means, a rotary solenoid may be used.

The illustrated embodiment may be used in a process other than the process for forming holes Pb in core plates P of motor core M.

The switching member 25 and the shift plate 26 may be configured as one component. On one of the parts, a recessed connecting portion 26*a* for connecting the connecting bar 36 may be formed.

What is claimed is:

1. A punch press device comprising:

a lift movable up and down with respect to a workpiece;

a punch supported by the lift and movable up and down with respect to the lift;

a switching member that reciprocates between a position where the punch is constrained so as to move down together with the lift and a position where the punch is released so as to move up relative to the lift;

a first electromagnetic driver having a movable first armature moves the switching member in a first direction; and a second electromagnetic driver having a movable second armature, that is different from the first electromagnetic driver having the movable first armature, moves the switching member in a second direction opposite to the first direction, wherein the first and second electromagnetic drivers are spaced from one another so as to be arranged along parallel first and second armature movement direction axes.

2. The punch press device according to claim 1, further comprising:

a biaser that biases the switching member in one of the first and the second directions by a force smaller than a driving force of the electromagnetic drivers.

3. The punch press device according to claim 1, wherein the electromagnetic drivers are direct-acting electromagnetic solenoids.

4. The punch press device according to claim 1, wherein the electromagnetic drivers are a pair of direct-acting electromagnetic solenoids, armatures of the pair of direct-acting electromagnetic solenoids are arranged in parallel, the pair of direct-acting electromagnetic solenoids operates in opposite directions, the armatures of the pair of direct-acting electromagnetic solenoids are connected together by a connecting member, and the connecting member is connected to the switching member.

* * * * *